US010709236B2

(12) United States Patent
Patrick et al.

(10) Patent No.: US 10,709,236 B2
(45) Date of Patent: Jul. 14, 2020

(54) WORKSTATION WITH MOVEABLE TABLE PORTION

(71) Applicant: RedRick Technologies Inc., Mount Brydges (CA)

(72) Inventors: Gregory David Patrick, Mount Brydges (CA); Maurice Franciscus Zwinkels, Mount Brydges (CA); Vivian Francesca Dall'Armi, London (CA)

(73) Assignee: RedRick Technologies Inc., Mount Brydges (CA)

( * ) Notice: Subject to any disclaimer, the term of this patent is extended or adjusted under 35 U.S.C. 154(b) by 0 days.

(21) Appl. No.: 16/506,272

(22) Filed: Jul. 9, 2019

(65) Prior Publication Data

US 2020/0022492 A1 Jan. 23, 2020

Related U.S. Application Data

(60) Provisional application No. 62/699,053, filed on Jul. 17, 2018.

(51) Int. Cl.
*A47B 21/03* (2006.01)
*A47B 13/08* (2006.01)

(52) U.S. Cl.
CPC ..... *A47B 21/03* (2013.01); *A47B 13/081* (2013.01); *A47B 13/088* (2013.01); *A47B 2200/0005* (2013.01)

(58) Field of Classification Search
CPC ... A47B 21/03; A47B 21/0314; A47B 13/088; A47B 2021/0307; A47B 2021/0321; A47B 2021/0392; A47B 2200/0005
(Continued)

(56) References Cited

U.S. PATENT DOCUMENTS 2,705,179 A * 3/1955 Hodgin ..... A47B 1/00 428/609
2,792,226 A * 5/1957 Champion ..... A63F 7/0017 273/123 R (Continued)

FOREIGN PATENT DOCUMENTS

CN 2798713 Y 7/2006
CN 104337230 A 2/2015

(Continued)

OTHER PUBLICATIONS

Mainline Computer: Single Operator Command Console technical specifications dated Apr. 26, 2018 from mainlinecomputer.com.

(Continued)

*Primary Examiner* — Jose V Chen
(74) *Attorney, Agent, or Firm* — Brunet & Co. Ltd.; Robert Brunet; Hans Koenig

(57) ABSTRACT

A workstation has two work surfaces that have interfaceable complementary concave and convex edges, and which are maintained in the same horizontal plane by moveable arms connecting the undersides of the two work surfaces. The moveable arms are operable to move one of the work surfaces in the horizontal plane both arcuately along the complementary edges and laterally toward and away from the other work surface. The work surface that moves relative to the other may support a keyboard or other computer input device, while the other work surface may support one or more computer monitors. The workstation is useful for any user having the need or desire for a multi-monitor configuration.

11 Claims, 8 Drawing Sheets

(58) Field of Classification Search
USPC ..... 108/50.01, 50.02, 104, 65
See application file for complete search history.

(56) References Cited

U.S. PATENT DOCUMENTS

| | | | | | |
|---|---|---|---|---|---|
| 4,546,708 | A * | 10/1985 | Wilburth | A47B 11/00 | 108/103 |
| 4,561,619 | A | 12/1985 | Robillard et al. | | |
| 4,733,618 | A * | 3/1988 | Sarro | A47B 21/0314 | 108/102 |
| 4,852,500 | A | 8/1989 | Ryburg et al. | | |
| 5,398,896 | A | 3/1995 | Terbrack | | |
| 5,416,666 | A * | 5/1995 | Maguire, Jr. | A47B 21/00 | 361/679.08 |
| 5,437,235 | A * | 8/1995 | Randolph | A47B 21/00 | 108/25 |
| 5,485,795 | A | 1/1996 | Williams | | |
| 5,522,323 | A * | 6/1996 | Richard | A47B 21/0073 | 108/10 |
| 5,605,311 | A * | 2/1997 | McGrath | A47B 17/033 | 248/118 |
| 5,676,068 | A * | 10/1997 | Kallander | A47B 13/10 | 108/64 |
| 5,704,298 | A * | 1/1998 | Corpuz, Jr. | A47B 17/065 | 108/50.01 |
| 5,704,299 | A * | 1/1998 | Corpuz, Jr. | A47B 21/0314 | 108/147 |
| 5,931,528 | A | 8/1999 | Shields | | |
| 5,967,058 | A * | 10/1999 | Ambrose | A47B 13/10 | 108/64 |
| 6,099,093 | A * | 8/2000 | Spence | A47B 21/03 | 108/50.01 |
| 6,152,411 | A | 11/2000 | Lundstrom | | |
| 6,220,181 | B1 * | 4/2001 | Horski | A47B 13/10 | 108/138 |
| 6,536,356 | B2 * | 3/2003 | Krieger | A47B 21/00 | 108/10 |
| 6,694,895 | B2 | 2/2004 | Gillis | | |
| 7,357,086 | B2 * | 4/2008 | Petrick | A47B 21/00 | 108/50.02 |
| 7,798,070 | B2 * | 9/2010 | Ooba | A47B 13/003 | 108/147 |
| 7,802,407 | B2 | 9/2010 | Haberman | | |
| 7,971,930 | B2 | 7/2011 | Larsen et al. | | |
| 8,051,782 | B2 * | 11/2011 | Nethken | A47B 21/02 | 108/50.01 |
| 8,225,723 | B2 * | 7/2012 | Nakamura | A47B 17/00 | 108/50.01 |
| 8,839,725 | B2 | 9/2014 | Kooistra et al. | | |
| 8,864,091 | B1 | 10/2014 | Patriarco | | |
| 2002/0020329 | A1 * | 2/2002 | Kowalski | A47B 21/00 | 108/50.01 |
| 2003/0196573 | A1 * | 10/2003 | Fischer | A47B 9/18 | 108/50.01 |
| 2004/0179331 | A1 * | 9/2004 | Maloney | A47B 21/0314 | 361/679.08 |
| 2005/0217540 | A1 * | 10/2005 | Novak | A47B 83/001 | 108/50.01 |
| 2006/0174807 | A1 * | 8/2006 | Dral | A47B 21/0073 | 108/50.01 |
| 2011/0226920 | A1 | 9/2011 | Moses | | |
| 2014/0102340 | A1 * | 4/2014 | Kooistra | A47B 9/00 | 108/105 |

FOREIGN PATENT DOCUMENTS

| | | | |
|---|---|---|---|
| CN | 204812677 | U | 12/2015 |
| WO | 2005/051124 | A1 | 6/2005 |

OTHER PUBLICATIONS

Mike O'Dwyer Ltd.: Curved Reception Desk online advertisement dated Apr. 26, 2018 from www.mikeodwyerofficefurniture.co.uk.
Apixl.org: Essential Dual Monitoring Articulating Arm Desk Mount online advertisement dated Apr. 27, 2018 from apixl.org.
Ergomart: Horizontal Sliding Roller Track System online advertisement dated May 13, 2016 from www.ergomart.com.

* cited by examiner

WORKSTATION WITH MOVEABLE TABLE PORTION

CROSS-REFERENCE TO RELATED APPLICATIONS

This application claims the benefit of U.S. patent application No. 62/699,053, the entirety of which is herein incorporated by reference.

FIELD

This application relates to a workstation having a moveable table portion, in particular to a computer workstation with a moveable keyboard portion.

BACKGROUND

Computer workstations generally comprise furniture (e.g. a desk or table) on which computer equipment including a central processing unit, a video monitor, a keyboard, a computer mouse, an external disk drive, and the like, as well as paperwork and other ancillary equipment and items are arranged. More recently, computer workstations have been developed that employ multiple output devices (e.g. video monitors) linked to a single central processing unit (CPU) controlled by a user from a common input device (e.g. keyboard and/or mouse). Such workstations are useful for tasks that require the user to observe data displayed on multiple output devices and provide data input separately to the data files or computer programs that are serving each of the output devices.

Current workstation furniture is generally inadequate for providing a configuration that can accommodate multiple output devices such as video monitors while providing an ergonomically sound capability that permits a user to change location and orientation to more easily view any particular output device supported on the workstation. There remains a need for such a computer workstation.

SUMMARY

In one aspect, there is provided a workstation comprising: a first work surface having a concave edge; a second work surface having a convex edge complementary to and interfaceable with the concave edge of the first work surface; a support structure attached to the first work surface for supporting the workstation with the first and second work surfaces oriented substantially horizontally in a same horizontal plane with respect to the ground; and, two moveable support arms connecting an underside of the first work surface to an underside of the second work surface, the support arms constraining the first and second work surfaces to prevent vertical movement of the work surfaces away from the same horizontal plane, the support arms operable to move the second work surface with respect to the first work surface in the same horizontal plane both arcuately along the complementary edges and laterally toward and away from the first work surface, each support arm having at least a first arm portion and first and second vertical pivot axes located on the horizontal plane, the second vertical pivot axis moveable relative to the first vertical pivot axis through the horizontal plane outside of an arc inscribed about the first vertical pivot axis, each support arm including either a translatable slide between the first and second vertical pivot axes permitting extension of the first arm portion or a second arm portion connected to the first arm portion by a third vertical pivot axis located between the first and second vertical pivot axes.

The workstation permits a user to change location and orientation of the second moveable work surface to accommodate the location on the first work surface at which the user chooses to work. The workstation is particularly designed for radiologists but is also useful for control room applications where one operator must view multiple video monitors in doing various tasks. Even so, the workstation is useful for any user having the need or desire for a multi-monitor configuration.

Further features will be described or will become apparent in the course of the following detailed description. It should be understood that each feature described herein may be utilized in any combination with any one or more of the other described features, and that each feature does not necessarily rely on the presence of another feature except where evident to one of skill in the art.

BRIEF DESCRIPTION OF THE DRAWINGS

For clearer understanding, preferred embodiments will now be described in detail by way of example, with reference to the accompanying drawings, in which.

DETAILED DESCRIPTION

Figure 1B:
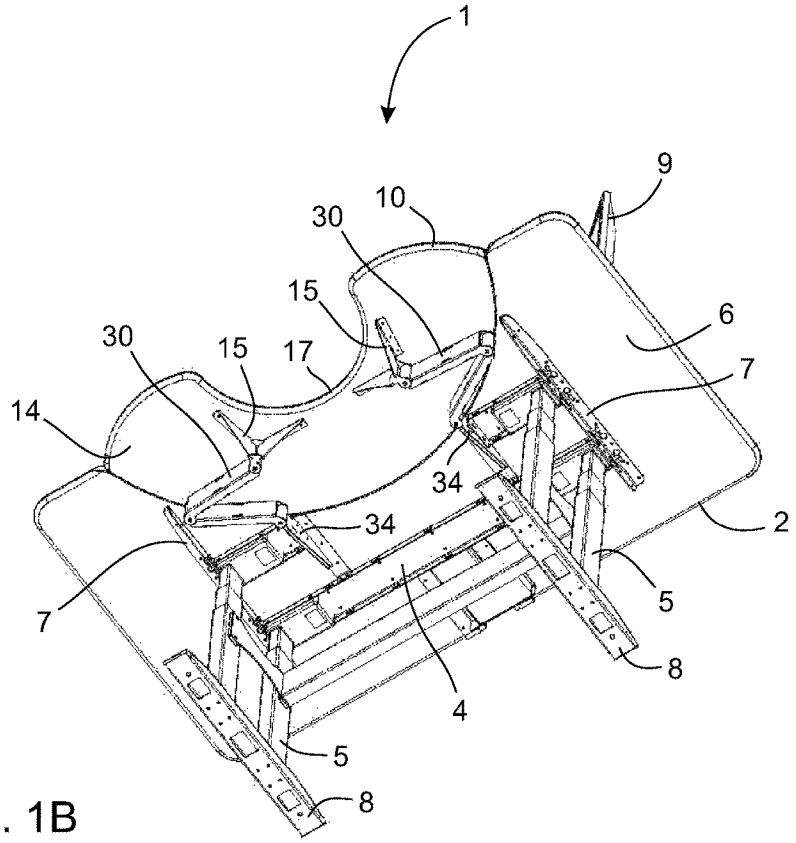
FIG. 1B is a bottom perspective view of the workstation of FIG. 1A.

The workstation may be a table, desk or the like at which a user can perform work, especially computer work. The workstation is especially adapted for supporting one or more computer monitors and one or more computer input devices such as a keyboard, a computer mouse, a joystick and the like. The workstation comprises a first work surface on which the one or more computer monitors may be supported and a second work surface on which the one or more input devices may be supported. The second work surface is moveable with respect to the first work surface to change the position and/or orientation of the second work surface with respect to the first work surface while maintaining both work surfaces in the same horizontal plane.

The first work surface may be supported by a support structure, for example one or more legs or the like supporting the first work surface on the ground, or one or more support brackets or the like supporting the first work surface on a ceiling or a vertically oriented surface such as a wall. The first work surface is oriented substantially horizontally however supported. The second work surface is supported on the first work surface by the support arms connecting an underside of the first work surface to an underside of the second work surface. The support structure for the first work surface may be adjustable to adjust the height of the work surfaces off the ground, provided the first and second work surfaces remain in the same horizontal plane.

The first work surface has a concave edge and the second work surface has a convex edge complementary to the concave edge of the first work surface so that the second work surface may be nested with the first work surface to effectively make a single work surface. The second work surface may also comprise a concave edge opposed to the convex edge, the opposed concave edge of the second work surface defining a niche for receiving a user at the second work surface. The support arms are moveable so that the position and/or orientation of the second work surface can be changed relative to the first work surface, thereby changing the position and orientation of the niche so that the user may comfortably view different portions of the first work surface without needing to turn the user's head with respect to the user's body. In this manner, a user may easily remain in an ergonomically sound posture while using a single item on the second work surface and viewing different portions of the first work surface, for example while using a single keyboard on the second work surface and viewing different monitors on the first work surface. The second work surface may further comprise elbow receiving elements, for example pads, depressions or the like, proximate the opposed concave edge of the second work surface to further enhance comfort for the user.

The support arms are moveable and are configured to permit arcuate movement of the second work surface relative to the first work surface about an arc constrained to have a curvature complementary to the convex portion of the second work surface in a plane defined by the first work surface. The moveable support arms are further configured to permit movement of the second work surface away from or toward the first work surface in the horizontal plane. The moveable support arms are configured to simultaneously permit both the arcuate movement of the second work surface and the movement of the second work surface away from or toward the first work surface in the same horizontal plane, while constraining the first and second work surfaces in the same horizontal plane. Other than the moveable support arms, there may be no connection between the first and second work surfaces; thus, the workstation may be devoid of tracks or other like structures.

The workstation may further comprise an interface structure between the concave edge of the first work surface and the convex edge of the second work surface. The interface structure reduces friction between the concave edge of the first work surface and the convex edge of the second work surface when the convex edge of the second work surface abuts the concave edge of the first work surface and the second work surface is moving arcuately with respect to the first work surface. The interface structure may be situated on the concave edge of the first work surface, the convex edge of the second work surface or both the concave edge of the first work surface and the convex edge of the second work surface. Preferably, the interface structure is on the convex edge of the second work surface. The interface structure preferably comprises a dry lubricant between the concave edge of the first work surface and the convex edge of the second work surface. In one embodiment, the dry lubricant may be a strip or powder coating of low surface energy plastic. Some examples of low surface energy plastics include a fluoropolymer (e.g. Teflon™), a polyacetal resin (e.g. Delrin™), a high-density polyethylene (HDPE), an ultrahigh molecular weight (UHMW) polyethylene, graphite impregnated polyethylene and graphite impregnated polypropylene. A single long strip or a plurality of shorter strips of the low surface energy plastic is preferred.

The combination of the moveable support arms and the interface structure provide fingertip pressure sliding of the second work surface with respect to the first work surface. Furthermore, the moveable support arms may be positioned beneath the first and second work surfaces to prevent interference between second work surface and the support structures (e.g. one or more legs) supporting the first work surface during movement of the second work surface.

Each support arm has at least a first arm portion and first and second vertical pivot axes located on the horizontal plane. The support arm is pivotally mounted to the first work surface at the first vertical pivot point. The support arm is pivotally mounted to the second work surface at the second vertical pivot point. The second vertical pivot axis is moveable relative to the first vertical pivot axis through the horizontal plane outside of an arc inscribed about the first vertical pivot axis. Moving the second work surface arcuately relative to the first work surface about the arc constrained to have a curvature complementary to the convex portion of the second work surface in a plane defined by the first work surface causes relative movement of the second vertical pivot axis to the first vertical pivot axis thereby causing rotation of the first arm portion about the first vertical pivot axis.

In one embodiment, each support arm includes a second arm portion connected to the first arm portion by a third vertical pivot axis located between the first and second vertical pivot axes. Moving the second work surface away from or toward the first work surface causes the support arm to straighten or fold, respectively, as a result of rotation of the second arm portion about the third pivot axis. In another embodiment, each support arm includes a translatable slide between the first and second vertical pivot axes permitting extension and retraction of the first arm portion when the second work surface is moved, respectively, away from or toward the first work surface. In both embodiments, the second work surface may be moved arcuately along the concave edge of the first work surface in the horizontal plane and/or translated away from or toward the first work surface in the horizontal plane while maintaining the first and second work surfaces in the same horizontal plane.

Each vertical pivot axis may pass through a corresponding pivot pin about which the support arm may rotate in the horizontal plane. The pivot pin may be rotationally supported within a complementary receiving tube by a bearing, for example a ball bearing or race of ball bearings. The pivot pin may be rotationally supported within the complementary receiving tube by two bearings. Rotational friction between the pivot pin and the bearing may be adjustable. The rotational friction may be adjustable by increasing or decreasing a clamping force along the pivot pin by tightening or loosening a threaded fastener. The threaded fastener may increase or decrease compression of a washer located between the fastener and the receiving tube. The pivot pin may comprise a braking mechanism that slows down and stops rotation about the pivot pin when the support arm reaches a limit to motion.

With reference to FIG. 1A, FIG. 1B, FIG. 2A, FIG. 2B, FIG. 3A, FIG. 3B, FIG. 4A, FIG. 4B, FIG. 5A, FIG. 5B and FIG. 5C, one embodiment of a computer workstation 1 comprises a desk portion 2 having a horizontal top worksurface 3 supported on the ground by a leg assembly 4 having a plurality of height adjustable legs 5 depending vertically downward from an underside 6 of the desk portion 2, the leg assembly 4 attached to the underside 6 of the desk portion 2 through mounts 7, the legs 5 terminating in feet 8 that are in contact with the ground. The desk portion 2 supports a plurality of computer monitors 9 thereon and is immobile on the ground when a user is using the workstation 1 and viewing the monitors 9. The computer workstation 1 further comprises a moveable keyboard portion 10 having a horizontal top worksurface 11 that supports computer input devices such as a keyboard 12 and a computer mouse 13. The keyboard portion 10 is moveably mounted to the desk portion 2 by a pair of support arms 30. The support arms 30 are connected to an underside 14 of the keyboard portion 10 by arm brackets 15 and to the underside 6 of the desk portion 2 by mounting bracket 34.

Figure 1A:
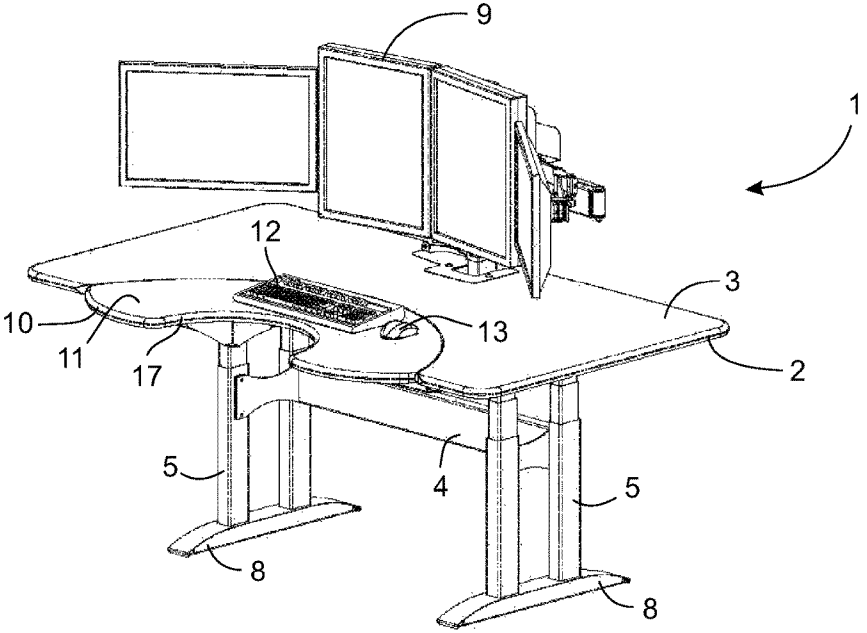
FIG. 1A is a perspective view of a workstation of the present invention with a moveable work surface nested in a non-moveable work surface.
Figure 3B:
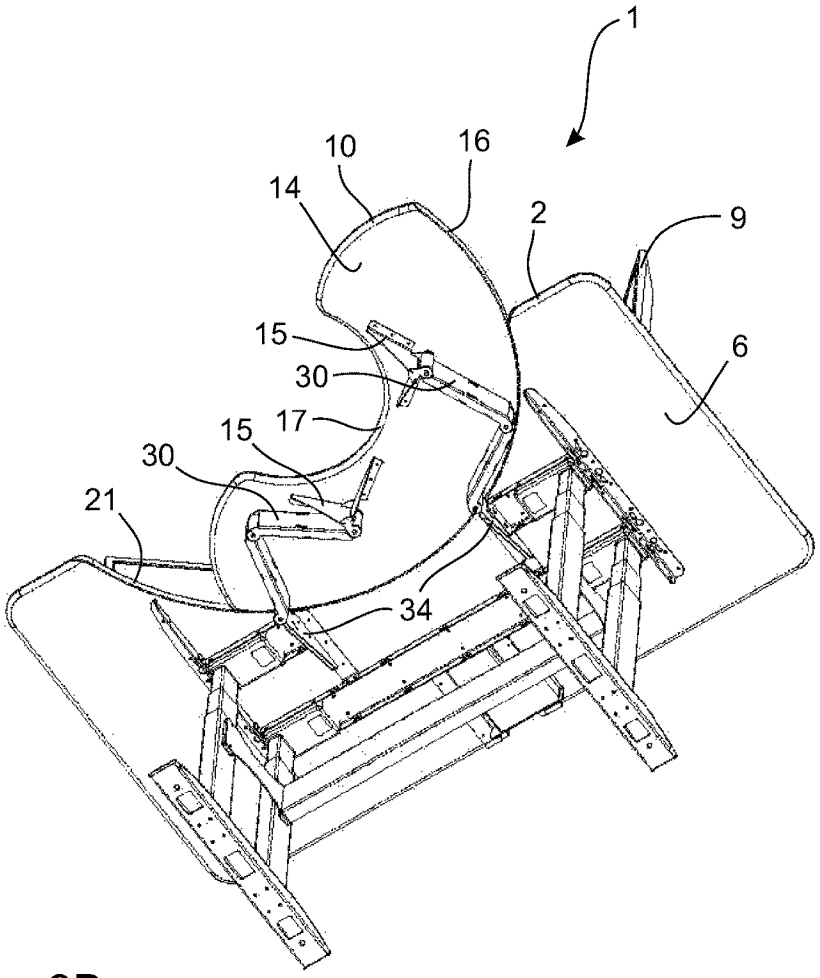
FIG. 3B is a bottom perspective view of the workstation of FIG. 3A.
Figure 3A:
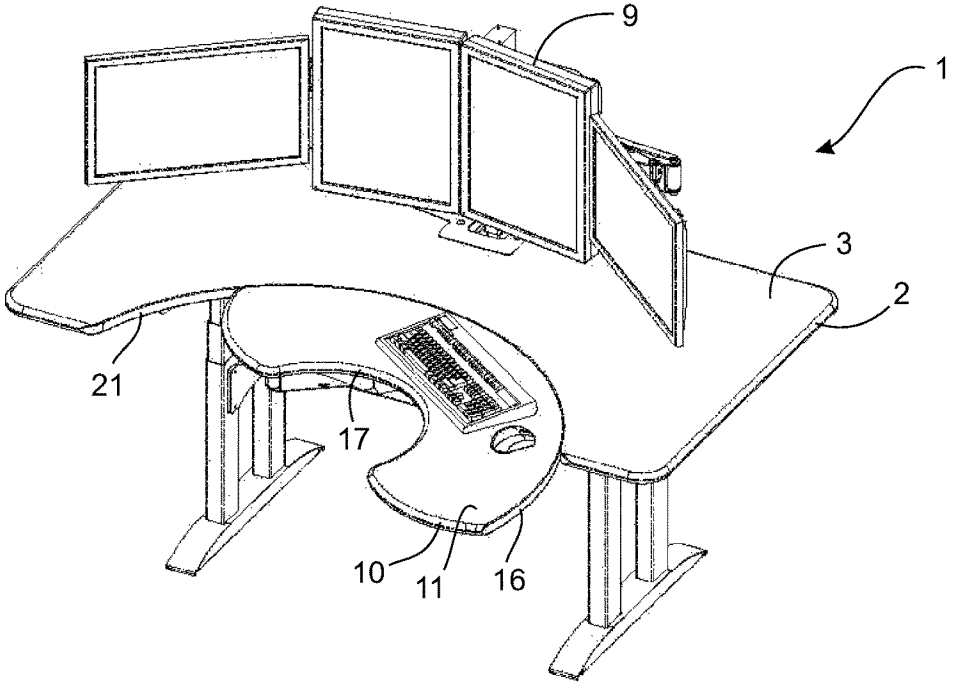
FIG. 3A is a perspective view of the workstation of FIG. 1A with the moveable work surface moved arcuately along the non-moveable work surface.

The desk portion 2 comprises a concave edge 21 facing toward the user when the user is working at the workstation 1. The keyboard portion 10 has a corresponding convex edge 16 facing away from the user at the workstation 1, which is nested in and abuts the concave edge 21 of the desk portion 2 when the workstation 1 is in a central compacted configuration as shown in FIG. 1A and FIG. 1B. The keyboard portion 10 further comprises a concave edge 17 opposed to the convex edge 16, the concave edge 17 of the keyboard portion 10 facing toward the user and defining a niche in which the user may sit or stand when working at the workstation 1. The convex edge 17 of the keyboard portion 10 comprises a Teflon™ coating to reduce friction between the convex edge 17 of the keyboard portion 10 and the concave edge 21 of the desk portion 2 when the keyboard portion 10 is moved arcuately along the desk portion 2 as shown in FIG. 3A and FIG. 3B.

Figure 2B:
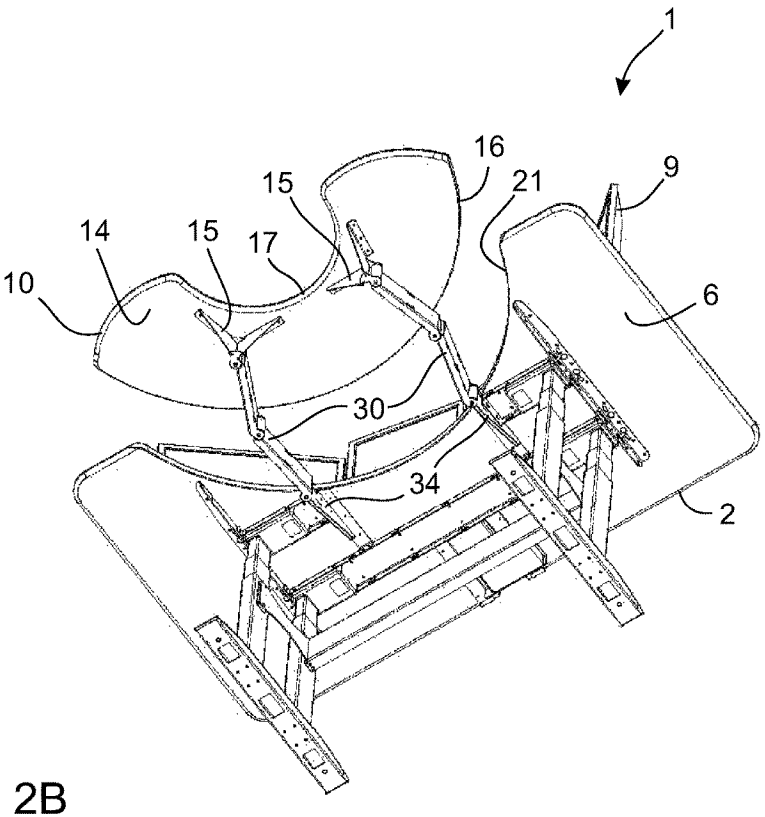
FIG. 2B is a bottom perspective view of the workstation of FIG. 2A.
Figure 2A:
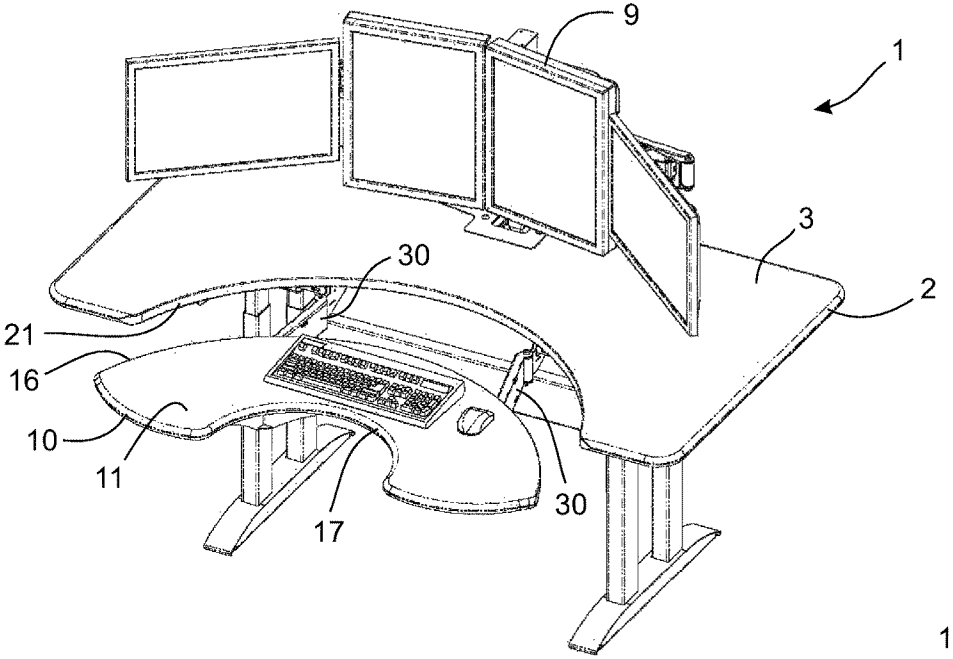
FIG. 2A is a perspective view of the workstation of FIG. 1A with the moveable work surface moved away from the non-moveable work surface.
Figure 4B:
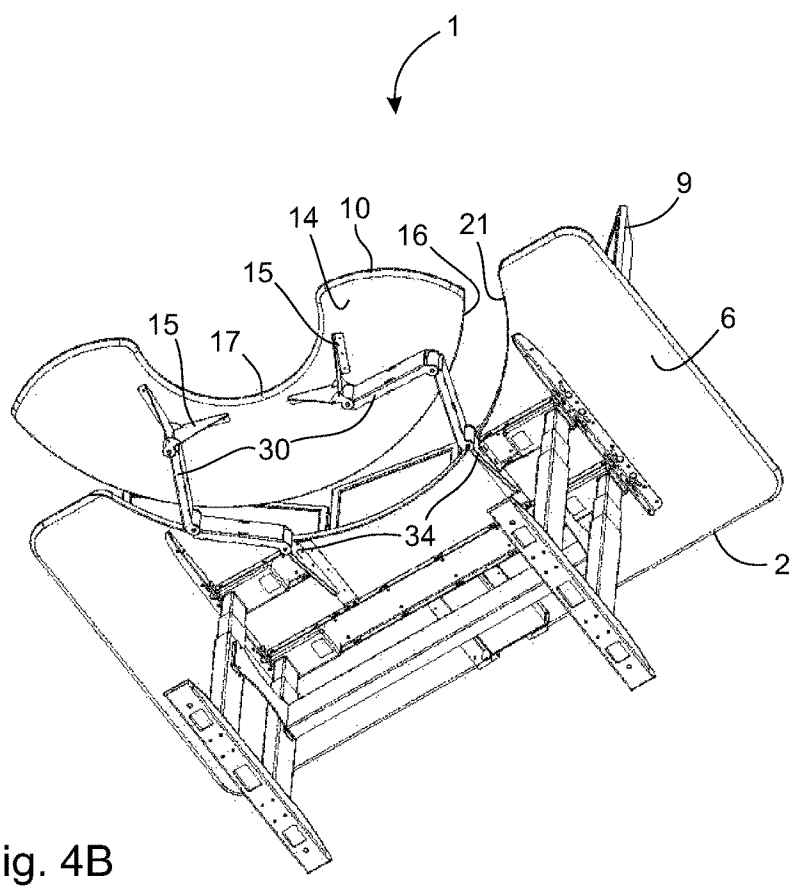
FIG. 4B is a bottom perspective view of the workstation of FIG. 4A.
Figure 4A:
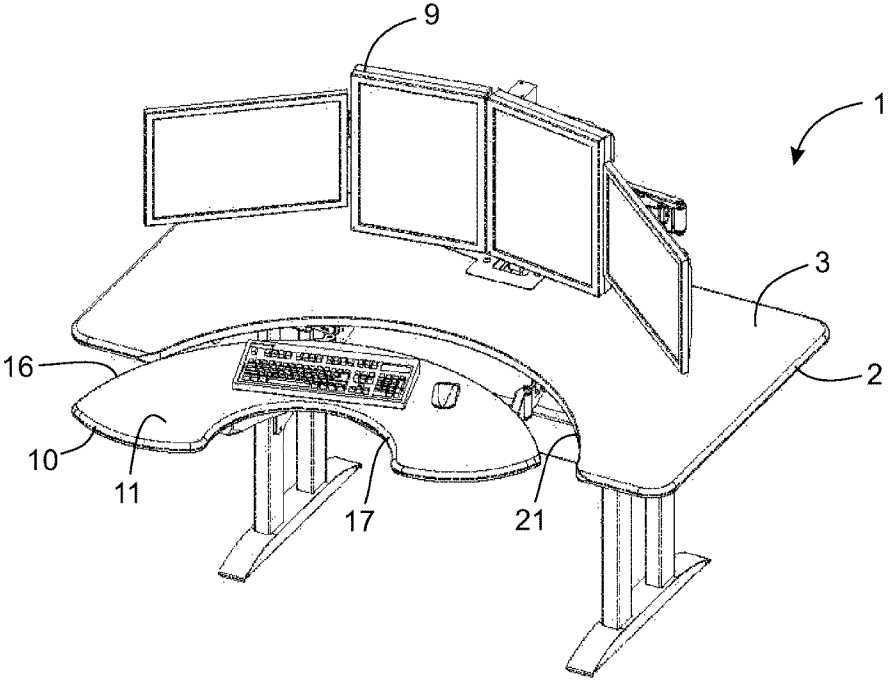
FIG. 4A is a perspective view of the workstation of FIG. 1A with the moveable work surface moved away from and arcuately along the non-moveable work surface.

The keyboard portion 10 may be moved relative to the desk portion 2 by virtue of the moveable support arms 30. The support arms 30 permit moving the keyboard portion 10 away from and toward the desk portion 2 as shown in FIG. 1A and FIG. 1B as compared to FIG. 2A and FIG. 2B, and as shown in FIG. 4A and FIG. 4B compared to FIG. 3A and FIG. 3B. Moving the keyboard portion 10 away from the desk portion 2 unfolds the support arms 30 thereby extending the support arms 30 to a greater extent, opening a gap between the desk portion 2 and the keyboard portion 10 as seen in FIG. 2A and FIG. 2B, and in FIG. 4A and FIG. 4B. Moving the keyboard portion 10 toward from the desk portion 2 folds the support arms 30 thereby retracting the support arms 30, closing the gap between the desk portion 2 and the keyboard portion 10 until the convex edge 16 of the keyboard portion 10 abuts the concave edge 21 of the desk portion 2 as seen in FIG. 1A and FIG. 1B, and in FIG. 3A and FIG. 3B. In addition to permitting movement of the keyboard portion 10 away from and toward the desk portion 2, the support arms 30 also permit arcuate movement of the keyboard portion 10 along the concave edge 21 of the desk portion 2, as shown in FIG. 2A and FIG. 2B, and FIG. 4A and FIG. 4B. The keyboard portion 10 may be moved right (FIG. 3A, FIG. 3B) or left (FIG. 4A, FIG. 4B) so that a user sitting at the workstation 1 in the niche of the keyboard portion 10 can more comfortably view the monitors 9 on the right and left side of the desk portion 2. While the keyboard portion 10 may be freely moved in and out and left and right with respect to the desk portion 2, the support arms 30 prevent the top worksurface 11 of the keyboard portion 10 from leaving a horizontal plane defined by the top worksurface 3 of the desk portion 2.

Figure 5B:
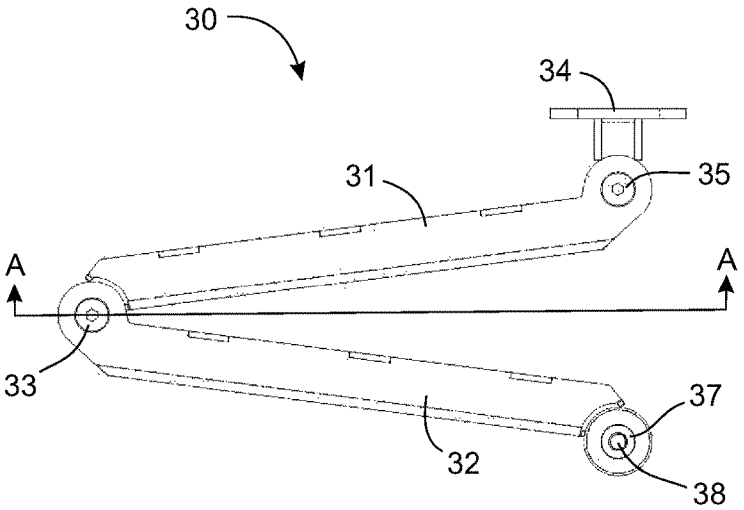
FIG. 5B is a top view of the support arm of FIG. 5A.
Figure 5C:
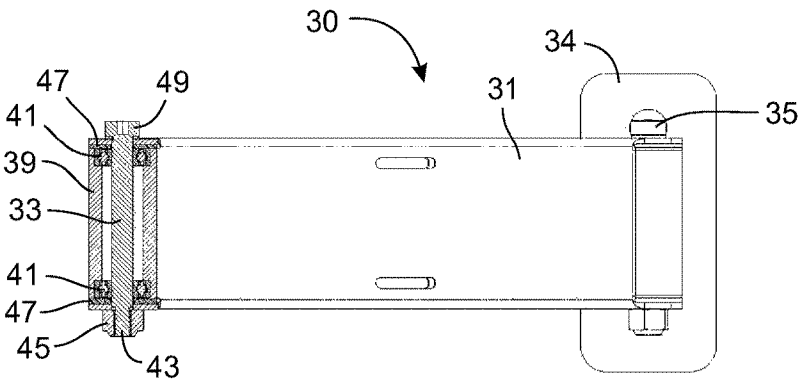
FIG. 5C is a view through section A-A from FIG. 5B.
Figure 5A:
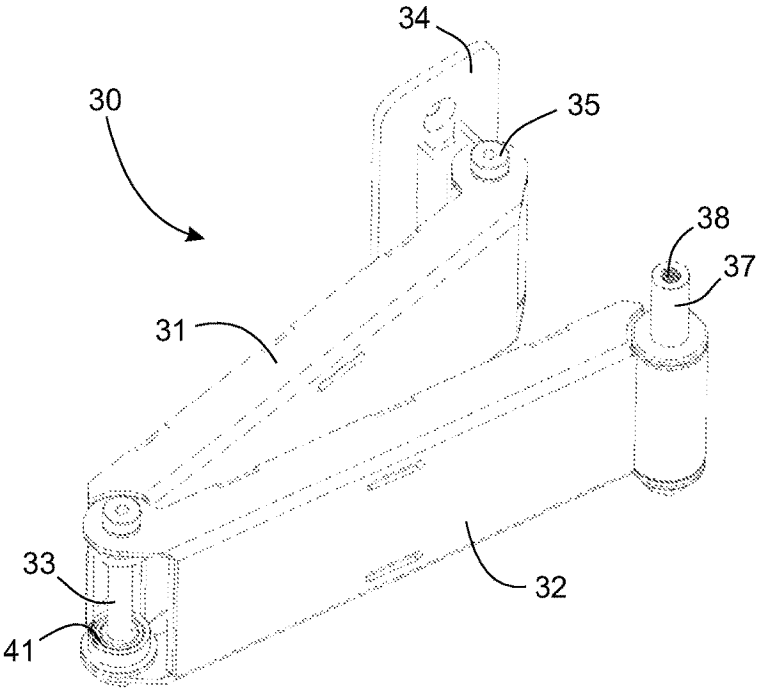
FIG. 5A is a magnified perspective view of a moveable support arm used in the workstation of FIG. 1A.
Figure 6B:
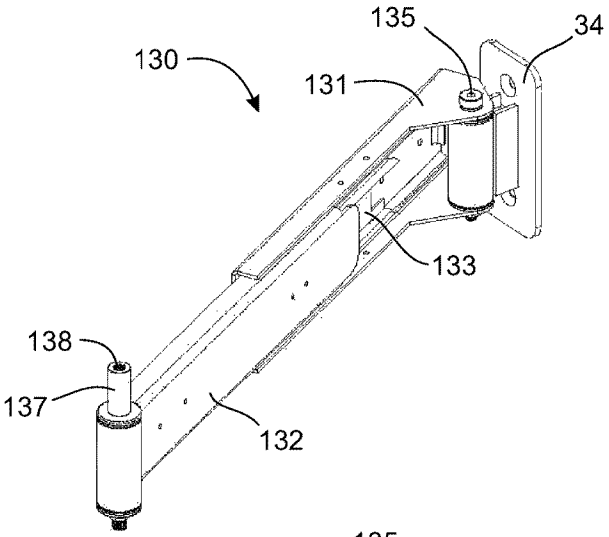
FIG. 6B shows the support arm of FIG. 6A with the slide shown in an extended position.
Figure 6D:
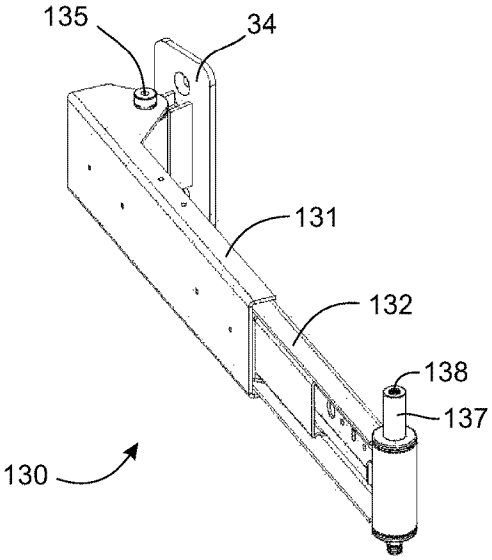
FIG. 6D shows the support arm of FIG. 6C with the slide shown in an extended position.
Figure 6A:
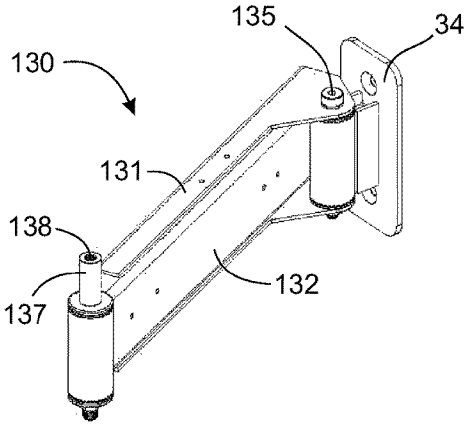
FIG. 6A is a perspective view of an alternate embodiment of a support arm in which a translatable slide permits extension of the support arm, the slide shown in a retracted position.
Figure 6C:
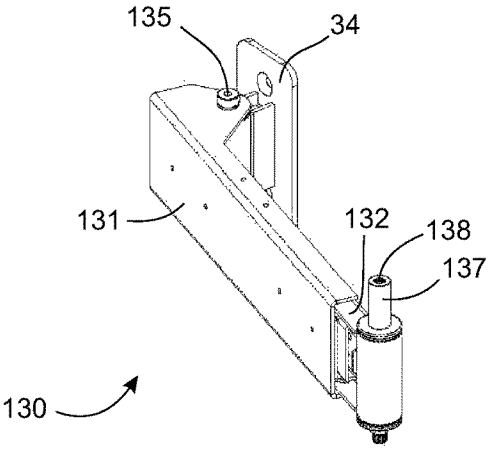
FIG. 6C shows the support arm of FIG. 6A having been rotated about a vertical pivot axis so that the support arm points in a different direction.
Figure 6E:
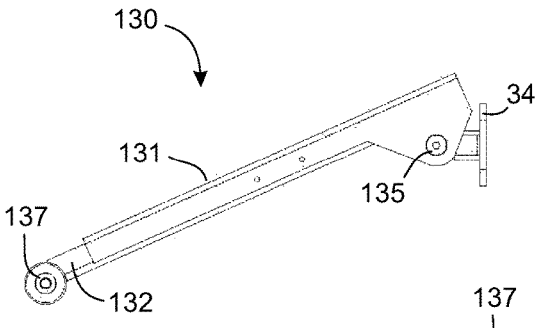
FIG. 6E is a side view of the support arm of FIG. 6A.
Figure 6F:
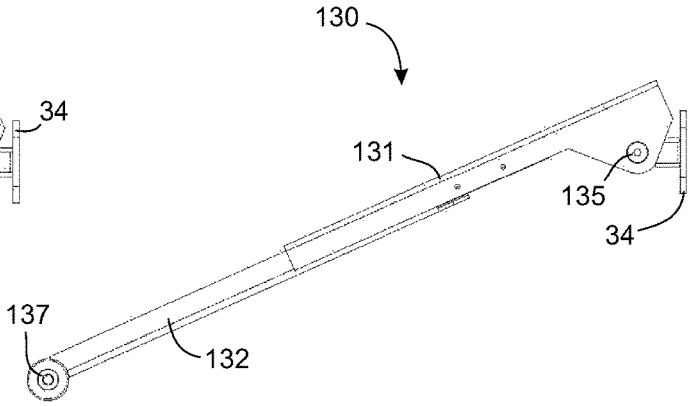
FIG. 6F is a side view of the support arm of FIG. 6B.
Figure 6G:
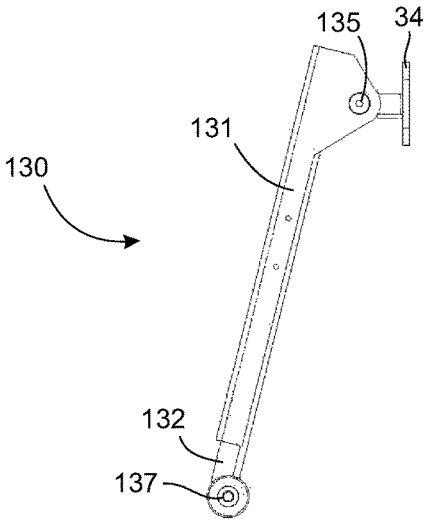
FIG. 6G is a side view of the support arm of FIG. 6C.
Figure 6H:
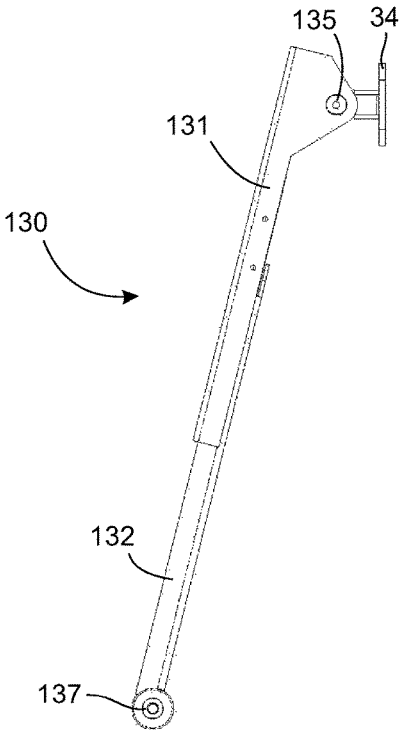
FIG. 6H is a side view of the support arm of FIG. 6D.

With particular reference to FIG. 5A, FIG. 5B and FIG. 5C, each of the moveable support arms 30 comprises first and second arm portions 31, 32, respectively, having ends thereof pivotally connected together by a third vertically oriented pivot pin 33. Another end of the first arm portion 31 is pivotally connected to the mounting bracket 34 by a first vertically oriented pivot pin 35, while another end of the second arm portion 32 comprises a second vertically oriented pivot pin 37 having a threaded bore 38. The mounting bracket 34 mounts the support arm 30 to the underside 6 of the of the desk portion 2, while the threaded bore 38 accepts a bolt to secure the support arm 30 to the arm brackets 15 mounted on the underside 14 of the keyboard portion 10. Each of the pivot pins 33, 35 and 37 permit rotations of the arm portions 31, 32 around vertical axes thereby folding or unfolding the support arm 30 in response to moving the keyboard portion 10 mounted on the second arm portion 32. However, the support arm 30 is unable to rotate about any horizontal axis thereby constraining motion of the keyboard portion 10 to remain in the same horizontal plane.

With specific reference to FIG. 5C, the pivot pin 33 is received within a vertically oriented tube 39 at the top and bottom of which a pair of ball bearings 41 are situated to support the pivot pin 33 in the tube 39. The ball bearings 41 permit the pivot pin 33 to freely rotate within the tube 39. The pivot pin 33 comprises screw threads at a bottom portion 43 thereof protruding out an end of the tube 39, the screw threads mated with and secured in a nut 45 to hold the pivot pin 33 in place. Further, washers 47 are located between a head 49 of the pivot pin 33 and one of the bearings 41, and between the nut 45 and the other of the bearings 41 so that tightening and loosening of the pivot pin 33 in the nut 45 changes pressure applied to the washers 47, which changes the clamping force between the bearings 41 and the pivot pin 33 thereby adjusting rotational friction between the bearings 41 and the pivot pin 33. Adjusting the rotational friction between the bearings 41 and the pivot pin 33 controls the ability of the support arm 30 to move in response to attempts to move the keyboard portion 10. Sufficient tightening of the pivot pin 33 in the nut 45 can prevent movement pivoting altogether. The other pivot pins 35, 37 may be constructed in the same way as the pivot pin 33. Movement of the keyboard portion 10 can be prevented altogether with sufficient tightening of the pivot pins 33, 35, 37.

With reference to FIG. 6A, FIG. 6B, FIG. 6C, FIG. 6D, FIG. 6E, FIG. 6F, FIG. 6G, FIG. 6H, FIG. 7A and FIG. 7B, another embodiment of a support arm 130 useable in the present invention is shown in which first and second arm portions 131, 132, respectively, are connected by a slide mechanism 133 so that the second arm portion 132 can slide longitudinally with respect to the first arm portion 131. The second arm portion 132 is nested within the first arm portion 131 in a telescoping arrangement, which allows the second arm portion 132 to extend and retract in response to inward and outward movement of the keyboard portion 10 with respect to the desk portion 2. One end of the first arm portion 131 is pivotally connectable to the mounting bracket 34 by a first vertically oriented pivot pin 135. One end of the second arm portion 132 comprises a second vertically oriented pivot pin 137 having a threaded bore 138. The mounting bracket 34 mounts the support arm 130 to the underside 6 of the of the desk portion 2, while the threaded bore 138 accepts a bolt to secure the support arm 130 to the arm brackets 15 mounted on the underside 14 of the keyboard portion 10. Each of the pivot pins 135 and 137 permit rotations of the arm portions 131, 132 around vertical axes thereby permitting arcuate movement the support arm 130 in response to moving the keyboard portion 10 mounted on the second arm portion 132. However, the support arm 130 is unable to rotate about any horizontal axis thereby constraining motion of the keyboard portion 10 to remain in the same horizontal plane.

Figure 7A:
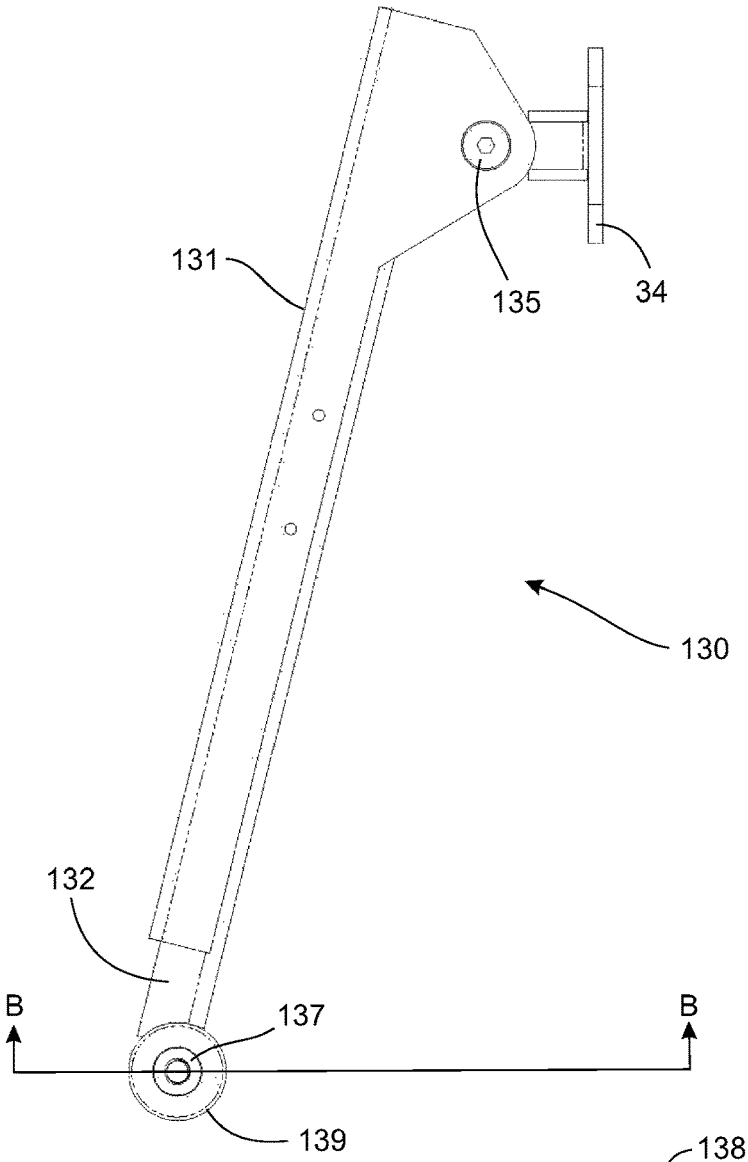
FIG. 7A is a magnified view of FIG. 6G.
Figure 7B:
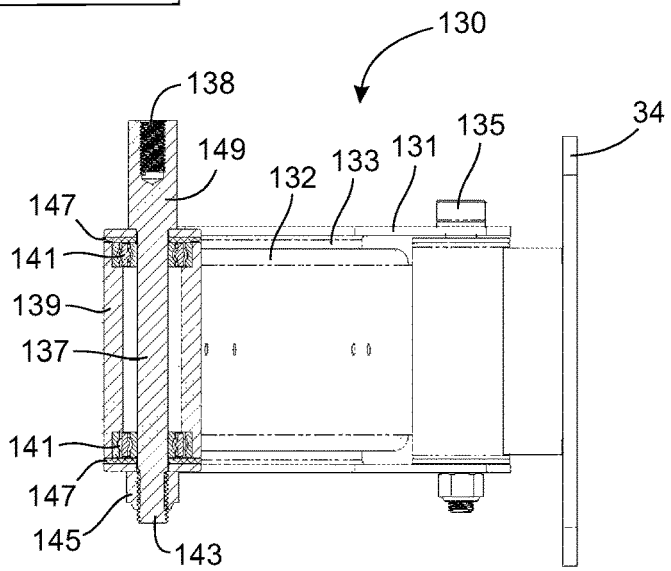
FIG. 7B is a view through section B-B from FIG. 7A.

As seen in FIG. 7B, the pivot pin 137 may be constructed similarly to the pivot pin 33 in the support arm 30. Thus, the pivot pin 137 is received within a vertically oriented tube 139 at the top and bottom of which a pair of ball bearings 141 are situated to support the pivot pin 137 in the tube 139. The ball bearings 141 permit the pivot pin 137 to freely rotate within the tube 139. The pivot pin 137 comprises screw threads at a bottom portion 143 thereof protruding out an end of the tube 139, the screw threads mated with and secured in a nut 145 to hold the pivot pin 137 in place. Further, washers 147 are located between a head 149 of the pivot pin 137 and one of the bearings 141, and between the nut 145 and the other of the bearings 141 so that tightening and loosening of the pivot pin 137 in the nut 145 changes pressure applied to the washers 147, which changes the clamping force between the bearings 141 and the pivot pin 137 thereby adjusting rotational friction between the bearings 141 and the pivot pin 137. Adjusting the rotational friction between the bearings 141 and the pivot pin 137 controls the ability of the support arm 130 to move arcuately in response to attempts to move the keyboard portion 10. Sufficient tightening of the pivot pin 137 in the nut 145 can prevent movement pivoting altogether. The other pivot pin 135 may be constructed in the same way as the pivot pin 137. Movement of the keyboard portion 10 can be prevented altogether with sufficient tightening of the pivot pins 135, 137.

The novel features will become apparent to those of skill in the art upon examination of the description. It should be understood, however, that the scope of the claims should not be limited by the embodiments, but should be given the broadest interpretation consistent with the wording of the claims and the specification as a whole.

The invention claimed is:

1. A workstation comprising:

a first work surface having a concave edge;

a second work surface having a convex edge complementary to and interfaceable with the concave edge of the first work surface;

a support structure attached to the first work surface for supporting the workstation with the first and second work surfaces oriented substantially horizontally in a same horizontal plane with respect to the ground; and, two moveable support arms connecting an underside of the first work surface to an underside of the second work surface, the support arms constraining the first and second work surfaces to prevent vertical movement of the work surfaces away from the same horizontal plane, the support arms operable to move the second work surface with respect to the first work surface in the same horizontal plane both arcuately along the complementary edges and laterally toward and away from the first work surface, each support arm having at least a first arm portion and first and second vertical pivot axes located on the horizontal plane, the second vertical pivot axis moveable relative to the first vertical pivot axis through the horizontal plane outside of an arc inscribed about the first vertical pivot axis, each support arm including either a translatable slide between the first and second vertical pivot axes permitting extension of the first arm portion so that the second vertical pivot axis moves relative to the first vertical pivot axis through the horizontal plane outside of the arc inscribed about the first vertical pivot axis by the translatable slide, or a second arm portion connected to the first arm portion by a third vertical pivot axis located between the first and second vertical pivot axes so that the second vertical pivot axis moves relative to the first vertical pivot axis through the horizontal plane outside of the arc inscribed about the first vertical pivot axis by the first arm portion, wherein each vertical pivot axis passes through a corresponding pivot pin about which the support arm may rotate in the horizontal plane.

2. The workstation of claim 1, wherein the second work surface comprises a concave edge opposed to the convex edge, the opposed concave edge defining a niche for receiving a user at the second work surface.

3. The workstation of claim 1, further comprising an interface structure between the concave edge of the first work surface and the convex edge of the second work surface, the interface structure situated on the concave edge of the first work surface, the convex edge of the second work surface or both the concave edge of the first work surface and the convex edge of the second work surface.

4. The workstation of claim 3, wherein the interface structure is on the convex edge of the second work surface.

5. The workstation of claim 3, wherein the interface structure comprises a dry lubricant surface between the concave edge of the first work surface and the convex edge of the second work surface.

6. The workstation of claim 5, wherein the dry lubricant comprises a fluoropolymer, a polyacetal resin, a high-density polyethylene, an ultrahigh molecular weight polyethylene, graphite impregnated polyethylene or graphite impregnated polypropylene.

7. The workstation of claim 1, wherein each through a corresponding pivot pin that is rotationally supported within a complementary receiving tube by a bearing.

8. The workstation of claim 7, wherein rotational friction between the pivot pin and the bearing is adjustable.

9. The workstation of claim 8, wherein the rotational friction is adjustable by increasing or decreasing a clamping force along the pivot pin by tightening or loosening a threaded fastener.

10. The workstation of claim 9, wherein the threaded fastener increases or decreases compression of a washer located between the fastener and the receiving tube.

11. The workstation of claim 7, wherein the bearing comprises two bearings rotationally supporting the pivot pin.

* * * * *